US012692768B1

(12) United States Patent
Shah et al.

(10) Patent No.: US 12,692,768 B1
(45) Date of Patent: Jul. 28, 2026

(54) SWEETENING OF SOUR GAS WELLS

(71) Applicant: Saudi Arabian Oil Company, Dhahran (SA)

(72) Inventors: Syed Qayamuddin Shah, Dhahran (SA); Hussain A. Aborshaid, Al Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/038,061

(22) Filed: Jan. 27, 2025

(51) Int. Cl.
*E21B 41/02* (2006.01)
*E21B 43/16* (2006.01)

(52) U.S. Cl.
CPC ..... *E21B 41/02* (2013.01); *E21B 43/166* (2013.01)

(58) Field of Classification Search
CPC ..... E21B 41/02; E21B 43/00; E21B 43/122; E21B 43/166; E21B 43/123
See application file for complete search history.

(56) References Cited

U.S. PATENT DOCUMENTS 1,750,951 A * 3/1930 Beecher ..... E21B 43/122 417/142
3,100,528 A * 8/1963 Plummer ..... E21B 43/255 166/308.1
3,373,816 A * 3/1968 Cochran ..... E21B 19/22 175/203
3,791,447 A * 2/1974 Smith ..... E21B 37/00 166/384
4,151,260 A * 4/1979 Woertz ..... F24T 10/17 423/234
4,473,115 A * 9/1984 Oakes ..... E21B 41/02 166/371

(Continued)

FOREIGN PATENT DOCUMENTS

CA 2846805 A1 * 3/2013 ..... B01D 53/1468
CN 108999597 A * 12/2018 ..... E21B 43/123

(Continued)

OTHER PUBLICATIONS

Babayev et al., "Coiled Tubing Inverted Gas-Lift System Installation on the Norwegian Continental Shelf," SPE-173679-MS, presented at the SPE/ICoTA Coiled Tubing & Well Intervention Conference & Exhibition, The Woodlands, Texas, USA, Mar. 24-25, 2015, 21 pages.

(Continued)

*Primary Examiner* — Jennifer H Gay
(74) *Attorney, Agent, or Firm* — Fish & Richardson P.C.

(57) ABSTRACT

A well system includes a production tubing disposed in a wellbore from a terranean surface into a subterranean zone to a first depth in the wellbore. The subterranean zone includes a formation fluid that includes a hydrocarbon fluid having a first concentration of an acid gas, and the first concentration is greater than a threshold concentration of acid gas. The well system also includes a second tubing disposed in the wellbore and within the production tubing to a second depth in the wellbore less than the first depth. The second tubing includes an outlet to circulate a second fluid into the formation fluid disposed in the production tubing, and the second fluid dilutes the formation fluid in the production tubing to a second concentration of the acid gas that is less than the threshold concentration.

18 Claims, 2 Drawing Sheets

(56) References Cited

U.S. PATENT DOCUMENTS

| | | | | |
|---|---|---|---|---|
| 5,211,242 | A | 5/1993 | Coleman et al. | |
| 5,377,764 | A | 1/1995 | Jennings, Jr. | |
| 5,515,926 | A | 5/1996 | Boychuk | |
| 5,655,605 | A * | 8/1997 | Matthews | E21B 43/122 166/372 |
| 7,128,150 | B2 | 10/2006 | Thomas et al. | |
| 7,533,726 | B2 | 5/2009 | Gaskill | |
| 8,312,924 | B2 | 11/2012 | Smith | |
| 9,388,686 | B2 | 7/2016 | Konopczynski et al. | |
| 9,822,625 | B2 * | 11/2017 | Savari | E21B 36/001 |
| 10,316,633 | B2 * | 6/2019 | Savari | E21B 21/003 |
| 10,400,527 | B2 * | 9/2019 | Gamage | C09K 8/52 |
| 10,612,350 | B2 | 4/2020 | Steele et al. | |
| 10,677,002 | B2 * | 6/2020 | Gamage | E21B 37/06 |
| 11,624,264 | B2 * | 4/2023 | Al-Marri | E21B 47/006 166/250.15 |
| 11,732,541 | B2 * | 8/2023 | Stoesser | E21B 33/047 166/382 |
| 11,970,927 | B1 * | 4/2024 | Aborshaid | E21B 33/122 |
| 12,371,989 | B1 * | 7/2025 | Ilamah | E21B 47/10 |
| 2001/0045287 | A1 * | 11/2001 | Brewer | E21B 43/122 166/372 |
| 2004/0154790 | A1 * | 8/2004 | Cornelssen | E21B 33/03 166/75.13 |
| 2010/0108315 | A1 | 5/2010 | Stevens et al. | |
| 2010/0230112 | A1 * | 9/2010 | Cox | E21B 43/129 166/73 |
| 2010/0307765 | A1 * | 12/2010 | van Arkel | E21B 43/16 166/372 |
| 2013/0056214 | A1 * | 3/2013 | Alsop | B01D 53/1468 166/310 |
| 2013/0160994 | A1 * | 6/2013 | Alsop | E21B 43/16 166/305.1 |
| 2013/0312974 | A1 * | 11/2013 | McClung, IV | C09K 8/68 166/308.1 |
| 2014/0000874 | A1 * | 1/2014 | Alsop | C09K 8/582 166/268 |
| 2014/0166288 | A1 * | 6/2014 | Bailey | C09K 8/54 166/305.1 |
| 2014/0262231 | A1 * | 9/2014 | Alam | E21B 43/28 166/305.1 |
| 2014/0290951 | A1 * | 10/2014 | Al-Taq | E21B 37/06 166/300 |
| 2015/0144333 | A1 | 5/2015 | Lee et al. | |
| 2017/0167211 | A1 * | 6/2017 | Gamage | C09K 8/536 |
| 2017/0226831 | A1 * | 8/2017 | Lugtmeier | E21B 43/122 |
| 2018/0193769 | A1 | 7/2018 | Ayres | |
| 2019/0323303 | A1 * | 10/2019 | Gamage | C09K 8/03 |
| 2019/0323304 | A1 * | 10/2019 | Gamage | C09K 8/52 |
| 2020/0173273 | A1 | 6/2020 | Thiruvenkatanathan | |
| 2021/0115786 | A1 | 4/2021 | Cerrahoglu et al. | |
| 2021/0148199 | A1 | 5/2021 | Thiruvenkatanathan | |
| 2021/0388716 | A1 | 12/2021 | Cerrahoglu et al. | |
| 2022/0120163 | A1 * | 4/2022 | Al-Marri | E21B 47/07 |
| 2022/0251919 | A1 * | 8/2022 | Stoesser | E21B 33/047 |
| 2025/0243753 | A1 * | 7/2025 | Iiamah | E21B 34/06 |

FOREIGN PATENT DOCUMENTS

| | | | | |
|---|---|---|---|---|
| CN | 113090231 | A * | 7/2021 | E21B 19/22 |
| GB | 2255995 | A * | 11/1992 | E21B 17/203 |

OTHER PUBLICATIONS

Barsoum et al., "Diluting Acid Gases With Sweet Gases in Gas Lift Systems: Assessment, Challenges, and Recommendations," SPE 95714, presented at the SPE Annual Technical Conference and Exhibition, Dallas, Texas, Oct. 9-12, 2005, 12 pages.

Guo et al., "Production Enhancement in Deep Sour Gas Field: A Case Study in China." SPE-202012-MS, presented at the SPE Russian Petroleum Technology Conference, Virtual, Oct. 26-29, 2020, 12 pages.

Ilamah et al., "Field-Scale Production Optimization with Intelligent Wells," presented at the SPE Europec featured at 80th EAGE Conference and Exhibition, Copenhagen, Denmark, Jun. 2018, 12 pages.

Mubashir et al., "Sour Gas Well Testing Challenges—A Successful Case Study," SPE-197482-MS, presented at the Abu Dhabi International Petroleum Exhibition & Conference, Abu Dhabi, UAE, Nov. 11-14, 2019, 17 pages.

Sturman et al., "Control of Hydrogen Sulfide in Oil and Gas Wells With Nitrite Injection," SPE-56772-MS, presented at the SPE Annual Technical Conference and Exhibition, Houston, Texas, Oct. 3-6, 1999, 7 pages.

Thompson et al., "Predicting the Reservoir Response to Intelligent Wells," presented at the SPE European Petroleum Conference, Paris, France, Oct. 24-25, 2000, 25 pages.

Wilhelm et al., "Selection of Materials for Sour Service in Petroleum Production," SPE-16040-PA, J Pet Technol, Oct. 1986, 38(10):1051-1061, 11 pages.

* cited by examiner

SWEETENING OF SOUR GAS WELLS

TECHNICAL FIELD

This disclosure relates to injection systems in wellbores, and more particularly to injection systems for dilution of sour gas wells.

BACKGROUND

Hydrocarbons extracted from a reservoir can contain various impurities. Hydrocarbons that are contaminated with significant amounts of sulfur compounds, such as hydrogen sulfide, are considered sour, while hydrocarbons that are contaminated with little or negligible amounts of sulfur compounds are considered sweet. Hydrogen sulfide is highly poisonous, corrosive, and flammable, so the presence and handling of hydrogen sulfide is an operational concern (such as corrosion of equipment and piping) and a safety concern. In some cases, hydrocarbon refining processes include the removal of such impurities from raw hydrocarbons, for example, before the hydrocarbons are used or transformed into other products. The sour field challenges include high development and operating costs to maintain both equipment and personnel safety during operation.

SUMMARY

This disclosure describes well systems, for example, for sweetening sour gas.

In some aspects, a well system includes a production tubing disposed in a wellbore from a terranean surface into a subterranean zone to a first depth in the wellbore. The subterranean zone includes a formation fluid that includes a hydrocarbon fluid having a first concentration of an acid gas, where the first concentration is greater than a threshold concentration of acid gas. The well system also includes a second tubing disposed in the wellbore and within the production tubing to a second depth in the wellbore less than the first depth. The second tubing includes an outlet to circulate a second fluid into the formation fluid disposed in the production tubing, and the second fluid dilutes the formation fluid in the production tubing to a second concentration of the acid gas that is less than the threshold concentration.

Certain aspects of the disclosure encompass a method that includes supporting a production tubing in a wellbore from a terranean surface into a subterranean zone to a first depth in the wellbore. The subterranean zone includes a formation fluid that includes a hydrocarbon fluid having a first concentration of an acid gas, where the first concentration is greater than a threshold concentration of acid gas. The method also includes supporting a second tubing in the wellbore and within the production tubing to a second depth in the wellbore less than the first depth, guiding, with the second tubing, a second fluid to an outlet of the second tubing, and circulating, with the outlet of the second tubing, the second fluid into the formation fluid disposed in the production tubing. The second fluid dilutes the formation fluid in the production tubing to a second concentration of the acid gas that is less than the threshold concentration.

The details of one or more implementations of the subject matter described in this disclosure are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
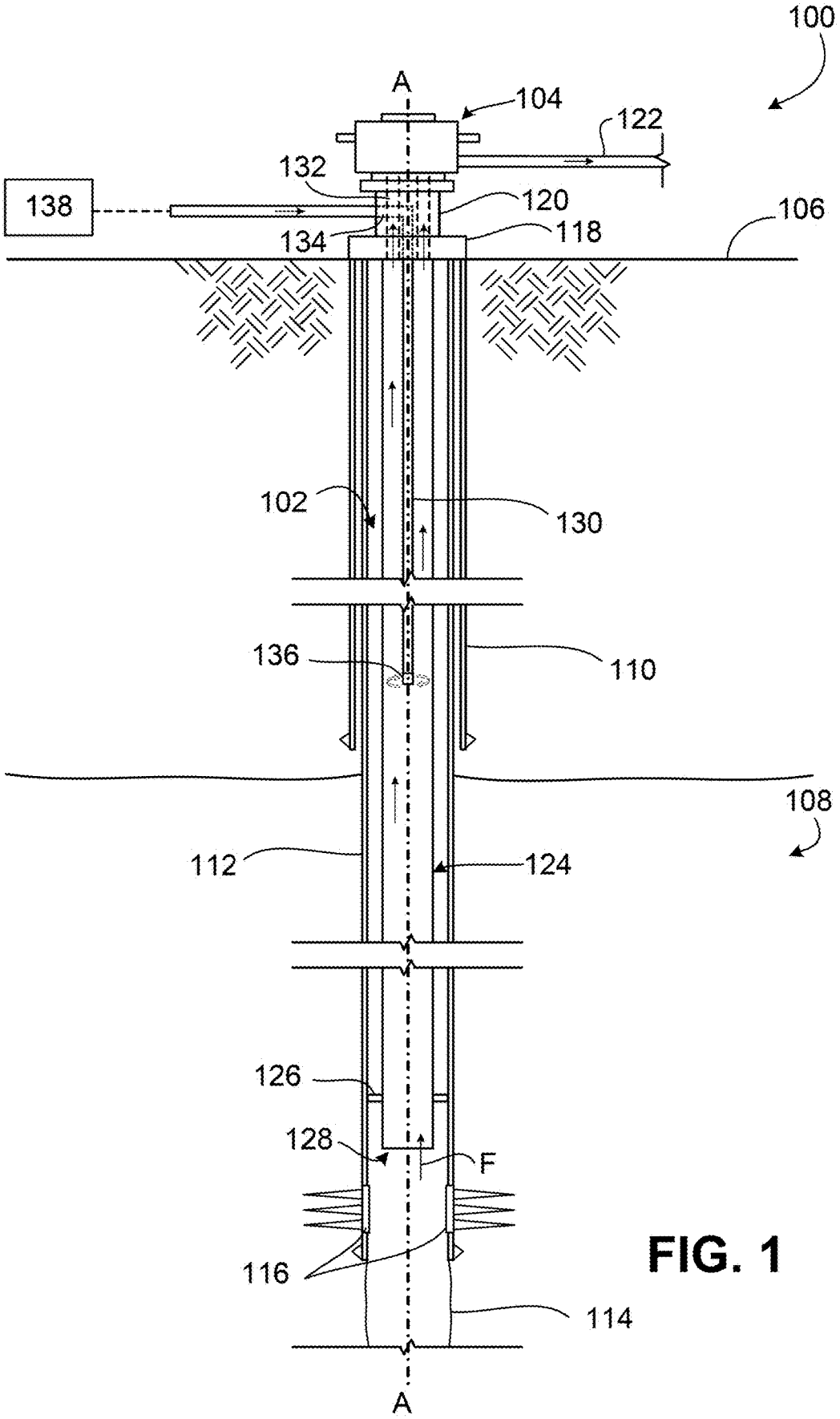
FIG. 1 is a schematic partial cross-sectional side view on an example well system.

This disclosure describes sweetening of hydrocarbons produced from sour gas wells. Sour gas includes certain acidic compounds, such as hydrogen sulfide ($H_2S$), that can introduce operational and safety issues due to their corrosive properties and toxicity. A gas is considered sour when the concentration of acidic components like $H_2S$ are above a threshold concentration, such as 4 parts per million (ppm), 5 ppm, 20 ppm, or more. In some working environments, the threshold concentration is 5 ppm based at least partially on personnel exposure. In some instances, a threshold fugacity equivalent is based on a sulphide stress cracking risk classifying a sour service field when the partial pressure value is 0.05 pounds per square inch (psi). A well system producing hydrocarbons from a sour hydrocarbon reservoir can dilute the concentration of the acidic components (like $H_2S$) to be above an acceptable concentration in situ by injection of a fluid into the production stream, where the fluid has little to no concentration of acidic components, such as a sweet has having a concentration of $H_2S$ that is less than 4 ppm, such as zero ppm. In the present disclosure, a well tubing, such as an injection tubing in the form of a coiled tubing or other flexible well string or utilizing sour grade OCTG tubing (J-55, L-80, etc.) as insert sting, is supported within a production tubing by an insertion spool at a wellhead in addition to any other spools as part of the wellhead. The insertion spool includes a dedicated hanger having separate pathways for injection and commingling of production post dilution. The well tubing includes a supply pathway through the well tubing for flowing a fluid, such as a sweet gas, out of the well tubing and into the production stream. The injection of the sweet gas commingles the fluid with the production stream, and dilutes the concentration of the acidic components in the commingled production stream, for example, to below the threshold concentration. The insertion spool supports the well tubing within the production tubing, and the well tubing receives sweet gas from a high-pressure gas source, such as an offset well or a sale gas production facility. A fluid outlet at a longitudinal end of the injection tubing is at a shallow depth in the wellbore, such as between 500 feet (ft) and 2,000 ft in depth from the well head, as compared to a deeper depth of the production tubing extending toward the reservoir formation that produces the sour gas. The insertion spool supports the well tubing independently from the production tubing, such that the injection of the fluid can be performed without affecting downhole equipment or surface equipment.

The subject matter described in this disclosure can be implemented in particular implementations, so as to realize one or more of the following advantages. The systems and methods described can be implemented to reduce a rupture exposure radius (RER) or wellhead radii (or dispersion radius) of producing gas wells. RER (or wellhead dispersion radii) is a safety measurement for determining a safe operating area around gas wells. Reducing RER or wellhead dispersion radii by implementing the systems and methods described can allow for production from sour gas wells in a safe and reliable manner in areas that otherwise would be deemed too risky for production. The systems and methods described can mitigate negative effects of acid components like $H_2S$ on downhole and surface equipment, extend the life of a well, reduce a bottom hole pressure of a wellbore by reducing a gas column density and enhance sandface drawdown, reduce vertical friction losses in a production tubing due to lighter gas column density, or a combination of these. An example injection system according to the present disclosure allows for a simplified well completion without significant modifications to downhole equipment or surface equipment, thereby allowing for production from sour gas wells with minimal effect on downhole and surface equipment and extending the life of a sour gas well. In some implementations, a well system of the present disclosure reduces $H_2S$ concentration of a produced hydrocarbon stream by dilution within the wellbore at a shallow depth, and does not impact or utilize original tubing casing annuli. An example well system with an injection system described is simple to operate, involves minimal installation costs relative to typical wellhead installation costs, and in some instances, does not require forced surface injection components, such as compressors or other pumps.

FIG. 1 is a schematic partial cross-sectional side view of an example well system 100 that includes a substantially cylindrical wellbore 102 extending from a wellhead 104 at a surface 106 downward into the Earth into one or more subterranean zones of interest. In the example well system 100 of FIG. 1, one subterranean zone of interest 108 is shown. The subterranean zone of interest 108 can include a formation with a hydrocarbon reservoir from which hydrocarbons can be extracted. In some implementations, the subterranean zone 108 can include multiple formations or a portion of a formation. The subterranean zone 108 can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some instances, the wellbore 102 can intersect other types of formations, including reservoirs that are not naturally fractured. The example well system 100 includes a vertical well, with the wellbore 102 extending substantially vertically from the surface 106 to the subterranean zone of interest 108. The concepts described here, however, are applicable to many different configurations of wells, including vertical, horizontal, slanted, split, or otherwise deviated wells.

In the example well system 100 of FIG. 1, the well 102 is a gas well used in producing hydrocarbon gas, such as natural gas, from the subterranean zone of interest 108 to the surface 106. While termed a "gas well," the well need not produce only dry gas, and may incidentally or in much smaller quantities, produce liquid including oil, water, or both. In some implementations, the well 102 is an oil well that is used in producing hydrocarbon liquid (such as crude oil) from the subterranean zones of interest 108 to the surface 106. While termed an "oil well," the well need not produce only hydrocarbon liquid, and may incidentally or in much smaller quantities, produce gas, water, or both. In some implementations, the production from the well 102 can be multiphase in any ratio. In some implementations, the production from the well 102 can produce mostly or entirely liquid at certain times and mostly or entirely gas at other times. For example, in certain types of wells it is common to produce water for a period of time to gain access to the gas in a subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

After some or all of the wellbore 102 is drilled, a portion of the wellbore 102 extending from the wellhead 104 to the subterranean zone 108 can be lined with lengths of tubing, called casing. The wellbore 102 can be drilled in stages, and a casing may be installed between stages. In the example well system 100 of FIG. 1, the wellbore 102 is shown as having been drilled in multiple stages (for example, two stages), and the casings include a first casing 110 and a second casing 112. The first casing 110 can be defined by lengths of tubing lining a first portion of the wellbore 102, and the second casing 112 can be defined by lengths of tubing lining a second portion of the wellbore 102. These portions of the wellbore 102 can be overlapping. For example, the first casing 110 extends from the surface for a first length, and the second casing 112 extends from the surface for a second, longer length that overlaps the first length. The first casing 110 is shown as extending only partially down the wellbore 102; however, the first casing 110 can extend further into the wellbore 102, such as into the subterranean zone 108, or end further uphole in the wellbore 102 than what is shown schematically in FIG. 1. Likewise, the second casing 112 is shown as extending only partially along the wellbore 102 downhole of the first casing 110; however, the second casing 112 can extend further into the wellbore 102 or end further uphole in the wellbore 102 than what is shown schematically in FIG. 1. While FIG. 1 shows the example well system 100 as having two casings (first casing 110 and second casing 112), the example well system 100 can include more surface casings or fewer surface casings, or more or fewer casings that begin at a location downhole of the surface 106. For example, the well system 100 can include one, three, four, or more surface casings, and any number of downhole casings. In some examples, the well system 100 excludes casings, and the wellbore 102 is at least partially or entirely open bore. The section(s) of the wellbore 102 exposed to the adjacent formation (for example, without casing or other permanent completion) form an open hole section 114 of the wellbore 102.

In some implementations, after all or a portion of the wellbore 102 is drilled, the wellbore 102 is completed with a sandface 116 within the subterranean zone 108, such as adjacent to the formation and hydrocarbon reservoir. The sandface 116 acts as a physical interface between the formation and the wellbore 102. However, in some implementations, the sandface 116 is excluded from the well system 100.

The wellhead 104 is installed over the open wellbore 102 on top of the casing, such as the first casing 110 and second casing 112. In some implementations, the well system 100 includes a pipe or tubing installed in the wellbore 102 prior to the installation of the casings 110 and 112, called a conductor, positioned adjacent to the first casing 110. The conductor is set into the surface 106 of the Earth and provides a foundation for the wellbore 102 to be drilled. The conductor is typically the first string of casing installed in the wellbore 102, and is lowered into the wellbore 102 and cemented in place, driven into the surface 106 (such as by a pile driver, or jetted into place such as in offshore wells), or otherwise positioned in the wellbore 102. The example well system 100 of FIG. 1 can include a single conductor or multiple conductors in or around the wellbore 102.

The wellhead 104 defines an attachment point for other equipment of the example well system 100 to attach to the well 102. For example, the wellhead 104 can include a Christmas tree structure including valves used to regulate flow into or out of the wellbore 102. In the example well system 100 of FIG. 1, the wellhead 104 also includes a tubing hanger 118 and an insertion spool 120 incorporated into the structure of the wellhead 104. The insertion spool 120 allows for insertion and support of a flexible tubing into the wellbore 102, and the tubing hanger supports a production tubing in the wellbore, described in greater detail later. The wellhead 104 of the example well system 100 also includes an output pipeline 122 fluidly connected to the wellhead 104, for example, to direct production fluid flow from the wellbore 102 to another location, such as a processing facility, downstream pipeline, or other location.

In the example well system 100 of FIG. 1, a well string 124 is shown as having been lowered from the wellhead 104 at the surface 106 into the wellbore 102 to a first depth, for example, at or near the formation in the subterranean zone 108. In the example well system 100 of FIG. 1, the well string 124 is a production tubing that is run into the wellbore 102 into the subterranean zone 108 to the first depth. In some instances, the production tubing 124 is supported by the tubing hanger 118 at the wellhead 104, and extends from the tubing hanger 118 into the subterranean zone 108 for receiving production fluid from the formation. In some implementations, the well string 124 includes a sealing element 126, such as a packer element, at or near a downhole longitudinal end 128 of the production tubing 124 that seals an annulus of the wellbore 102 between an exterior wall of the well string 124 and an interior wall of the casing 112 (or other wall of the wellbore 102). The sealing element 126 can form a gas-tight and liquid-tight seal between the well string 124 and the casing 112 (or other wellbore 102 surface). For example, the sealing element 126 can be configured to at least partially seal against an interior wall of the wellbore 102 to separate (completely or substantially) a pressure in the wellbore 102 downhole of the sealing element 126 from a pressure in the annulus of the wellbore 102 uphole of the sealing element 126.

Although the example well system 100 of FIG. 1 shows a production tubing 124, the type of well string can vary. In some instances, the well string 124 includes a series of jointed lengths of tubing coupled end-to-end or a continuous (or, not jointed) coiled tubing. For example, the well string 124 can include a wireline, coiled tubing, drill string, production string, work string, testing string, or other well string with a well tubing used during the lifetime of the well system 100. The well string 124 can include a number of different well tools that can test, produce, intervene, or otherwise engage the wellbore 102. For example, the well string 124 can include one or more isolation packers (such as sealing element 126) to isolate a production zone or reservoir from an annulus uphole of the packer(s). The annulus is the annular space between the well string 124 and an inner wall of the wellbore 102, such as the inner wall of a casing or open bore portion of the wellbore 102.

A flow "F" of formation fluid (for example, hydrocarbons, sour gas, water, a mixture of these, or other formation fluid) flows though the well string 124, such as from a reservoir formation in the subterranean zone 108 into and uphole along the production tubing 124 toward the wellhead 104 at the surface 106. In certain implementations, the flow F can flow through the annulus of the wellbore 102 in addition to or instead of through the well string 124. In some examples, the reservoir contains sour gas having a concentration of acid gas (for example, $H_2S$) that is greater than a threshold concentration of acid gas. An example threshold concentration of acid gas is 4 ppm, though this threshold concentration can vary.

The example well system 100 also includes a well tubing 130 that is disposed within the production tubing 124 and is supported, partially or completely, by the insertion spool 120. The well tubing 130 and the production tubing 124 are fluidically isolated from each other along their respective longitudinal lengths. For example, the production tubing 124 guides fluid flow longitudinally uphole along the production tubing 124, and the well tubing 130 guides flow longitudinally downhole along the well tubing 130, and the fluid flows remain separate along a length of the well tubing 130. In some instances, the well tubing 130 is disposed concentrically with the production tubing 124, though the well tubing 130 need not be concentric with the production tubing 124.

The well tubing 130 extends into the wellbore 102 within the production tubing 124 to a second depth that is shallower than the first depth of the production tubing 124. For example, the first depth of the production tubing can be several thousand feet, such as 7,000 ft or more, and the second depth of the well tubing 130 can be less than the first depth, such as between 500 ft and 2,000 ft. The well tubing 130 can include a coiled tubing or other flexible tubing or utilizing sour grade OCTG tubing (J-55, L-80, etc.) as insert sting equipped to guide a flow of fluid along its longitudinal length. In some implementations, the well tubing 130 can be moved along the production tubing 124 to a different depth, such as further downhole or further uphole in the wellbore 102, to control a downhole location of the well tubing 130. In some implementations, the well tubing 130 is lowered to the second depth in a rigless operation.

The insertion spool 120 supports the well tubing 130 within the production tubing 124, but independently from the production tubing 124. For example, the well tubing 130 is supported by the insertion spool 120 and can be moved uphole or downhole independently from the production tubing 124. The insertion spool 120 allows for independent control of the well tubing 130 separately from operation of the production tubing 124 and its corresponding tubing hanger 118. In some implementations, the insertion spool 120 is installed in the wellhead 104 vertically above the tubing hanger 124. The insertion spool 120 allows for insertion and lowering the well tubing 130 into the wellbore 102 without disrupting the flow of production fluid F through the production tubing 124. For example, the insertion spool 120 can include a primary flow pathway 132 extending longitudinally through the insertion spool 120 to fluidly connect the production tubing 124 with the rest of the wellhead 104 and ultimately the output pipeline 122. The primary flow pathway 132 allows for continuous flow of fluid from the production tubing 124 and through the wellhead 104 during a production operation, independently from whether the well tubing 130 is installed in the wellbore 102 or not. A bypass pathway 134 through the insertion spool 120 allows for the well tubing 130 to be inserted into the insertion spool 120, such as through a lateral side of the insertion spool 120, and guided through the insertion spool 120 and into the wellbore 102 and within the production tubing 124 without disrupting the production flow F from the production tubing 124 and through the wellhead 104 toward the output pipeline 122.

The well tubing 130 includes a supply pathway through the well tubing 130 for flowing a fluid, such as a sweet gas, out of the well tubing 130 and into the fluid flow F through the production tubing 124. The well tubing 130 includes an outlet 136 to flow the fluid into the production tubing 124 and circulate with the formation fluid disposed in the production tubing 124. The fluid from the well tubing 130 mixes with the formation fluid stream to dilute formation fluid at the second depth to a concentration of the acid gas that is less than the threshold concentration. The well tubing 130 and insertion spool 120 form at least a portion of an injection system of the example well system 100 of FIG. 1, for example, to effect injection of a dilution fluid into the wellbore 102 to dilute an acid gas concentration of the produced fluid flowing through the production tubing 124. The injection system allows for a controlled and continuous flow of fluid, such as sweet gas, into the production tubing 124 via the well tubing 130.

The outlet 136 of the well tubing 130 acts to inject the fluid into the production tubing 124 for circulation with the production fluid flow F through the production tubing. In some implementations, the outlet 136 includes a nozzle that injects the fluid into the formation fluid flow F in the production tubing 124. The nozzle can improve the dilution effectiveness, mixing efficiency, or both, of the injected fluid with the formation fluid. In certain implementations, the outlet 136 includes multiple perforations through the well tubing 130 that collectively direct injection of the fluid into the formation fluid flow F in the production tubing 124. In some instances, the well tubing 130 includes a fluid valve to control the flow of fluid out of the outlet 136. For example, the fluid valve can be used to restrict or limit flow of the fluid to a desired flow rate sufficient to provide an amount of the fluid to the production tubing 124 that dilutes the production flow to a concentration that is at or below the threshold concentration of acid gas. In some implementations, the fluid valve controls the flow rate of the fluid out of the well tubing 130 to be proportional to a desired $H_2S$ concentration level of the formation fluid flow F.

The configuration of the well tubing 130 and the production tubing 124 of the example well system 100 allows fluid to be injected into the production fluid flow F through the production tubing 124 and mix with the production fluid before reaching the wellhead 104 at the surface 106 of the example well system 100. In some cases, the subterranean zone 108 includes a sour gas reservoir. Sour gas may cause operational issues (for example, corrode piping and/or other well equipment), so diluting (for example, sweetening) the sour gas to reduce the acidic content (for example, $H_2S$ content) before producing the gas at the surface 106 can be beneficial. The well tubing 130 directs and injects the fluid into the production tubing 124 to mix with the production fluid (such as sour gas) at the second depth of the well tubing 130 and dilute the acid gas content of the production fluid. The stream of fluid through the well tubing 130 can be a gas stream with reduced acid gas content in comparison to the reservoir fluid. For example, the fluid can include a sweet gas with a concentration of $H_2S$ that is less than 20 parts per million such as a sweet gas with an $H_2S$ concentration of 4 ppm or less, or zero ppm.

The formation fluid flowing through the production tubing 124 can be diluted to have an acid gas concentration that is lower than a threshold concentration, such as less than 4 ppm, or less than 20 ppm (for example, if the availability of sweet gas for injection is restricted). The diluted formation fluid then continues to flow to the surface 106 through production tubing 124. In some implementations, the $H_2S$ concentration of the diluted gas that is produced from the formation (after dilution from mixing with the fluid from well tubing 130) is in a range of about 1 ppm to about 20 ppm.

The well tubing 130 is fluidly connected to a source 138 of the fluid at the surface 106 that provides the fluid to the well tubing 130 unidirectional (one way) for injection into the production tubing 124. In some examples, the well tubing 130 provides the fluid in a unidirectional manner, such that the fluid can only flow one way, out of the well tubing 130. The source 138 of the fluid can vary. In some implementations, the source 138 includes a sweet gas pipeline, a second wellbore, a fluid treatment facility, or a combination of these. For example, the source 138 can include an offset well that is located separately from the wellbore 102. The offset well can be a sweet gas well that produces gas with a reduced acid gas concentration, such as a sweet gas with a concentration of acid gas that is 4 ppm or less. The sweet gas produces from the offset well can flow to the well tubing 130 and into the wellbore 102 for dilution of the production fluid flow F. The source 138 of the fluid can include a high operating pressure, such as between 1,000 psi and 4,000 psi. In some implementations, the injection system excludes a compressor or other fluid pump for directing fluid flow through the well tubing 130. For example, the operating pressure of the source 138 of the fluid is sufficient to supply the fluid to the well tubing 130 for injection into the wellbore 102.

The example well system 100 can be utilized for gas-to-gas dilution in sour wells, for example, to dilute $H_2S$ concentration at a shallow depth in the wellbore without affecting or changing a fluid composition at a sour gas reservoir. By diluting the fluid at a shallow depth and within the production tubing 124, the reservoir formation is not flooded with sweet gas, and the fluid flow composition through the porous media of the formation and at the wall of the wellbore 102 is unchanged. In some examples, the mass of $H_2S$ is not changed since dilution can occur at the shallow depth to avoid or address limitations of RER (or wellhead dispersion radii). The volume of sweet gas (or other fluid used for dilution) injected into the production tubing 124 through the well tubing 130 can be a one-time injection, for example, since an acid gas treatment plant can be available to treat the injected volume of fluid and recycle the fluid as needed.

Figure 2:
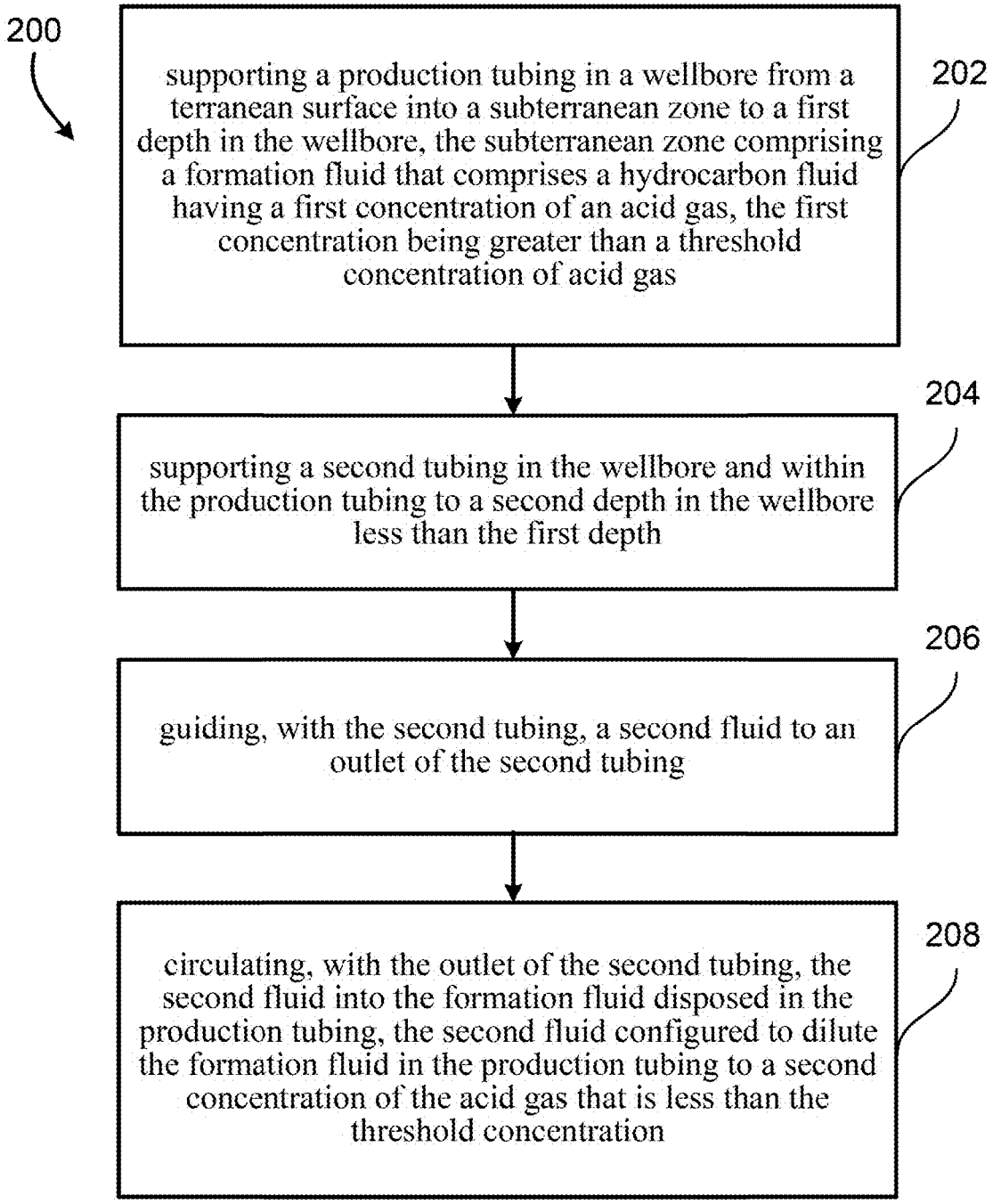
FIG. 2 is a flowchart describing an example method for diluting a formation fluid in a wellbore.

FIG. 2 is a flowchart describing an example method 200 for diluting a formation fluid in a wellbore, for example, performed by the example well system 100 of FIG. 1. At 202, a production tubing is supported in a wellbore from a terranean surface into a subterranean zone to a first depth in the wellbore. The subterranean zone includes a formation fluid that includes a hydrocarbon fluid with a first concentration of an acid gas, where the first concentration is greater than a threshold concentration of acid gas. At 204, a second tubing is supported in the wellbore and within the production tubing to a second depth in the wellbore that is less than the first depth. At 206, the second tubing guides a second fluid to an outlet of the second tubing. At 208, the outlet of the second tubing circulates the second fluid into the formation fluid disposed in the production tubing. The second fluid dilutes the formation fluid in the production tubing to a second concentration of the acid gas that is less than the threshold concentration. The second concentration can be a target concentration that is achievable based on the available volume of the second fluid and the concentration of acid gas of the second fluid. For example, the target concentration can include an expected or desired concentration of acid gas of the resultant production fluid based on a known volume of the second fluid and a known flow rate of production fluid from the wellbore. An insertion spool supports the second tubing independently from the production tubing in the wellbore. In some implementations, the second tubing fluidly connects to a source of the second fluid, and the second tubing guides the second fluid from the fluid source, through the second tubing, and out of the outlet. The fluid source can include one or more or all of a sweet gas pipeline, a second wellbore, or a fluid treatment facility. For example, the fluid source can include a second wellbore, and the second wellbore produces sweet gas that can be supplied, in full or in part, to the second tubing. In another example, the fluid source is a fluid treatment facility, and the second tubing receives a sweet gas from the fluid treatment facility.

In some implementations, the outlet includes a nozzle, and circulating the second fluid into the formation fluid disposed in the production tubing includes injecting the second fluid with the nozzle into the formation fluid in the production tubing. The nozzle improves the dilution effectiveness, mixing efficiency, or both, of the injected second fluid with the formation fluid. In certain implementations, the outlet includes one or more perforations through the second tubing, and circulating the second fluid into the formation fluid disposed in the production tubing includes injecting the second fluid through the perforations and into the formation fluid in the production tubing.

EXAMPLES

In a first aspect, a well system comprises a production tubing disposed in a wellbore from a terranean surface into a subterranean zone to a first depth in the wellbore. The subterranean zone comprises a formation fluid that comprises a hydrocarbon fluid having a first concentration of an acid gas, the first concentration being greater than a threshold concentration of acid gas. The well system comprises a second tubing disposed in the wellbore and within the production tubing to a second depth in the wellbore less than the first depth, the second tubing comprising an outlet configured to circulate a second fluid into the formation fluid disposed in the production tubing. The second fluid is configured to dilute the formation fluid in the production tubing to a second concentration of the acid gas that is less than the threshold concentration.

In a second aspect according to the first aspect, the well system further comprises a well head disposed at the terranean surface to support the production tubing in the wellbore, the well head comprising an insertion spool connected to the second tubing independently from the production tubing.

In a third aspect according to the second aspect, the second tubing comprises a flexible well tubing supported within the production tubing by the insertion spool.

In a fourth aspect according to the third aspect, the flexible well tubing comprises coiled tubing.

In a fifth aspect according to any one of the second aspect to the fourth aspect, the second tubing is fluidly connected to a source of the second fluid, the source of the second fluid comprising at least one of a sweet gas pipeline, a second wellbore, or a fluid treatment facility.

In a sixth aspect according to any one of the first aspect to the fifth aspect, the outlet of the second tubing comprises a nozzle configured to inject the second fluid into the formation fluid in the production tubing.

In a seventh aspect according to any one of the first aspect to the fifth aspect, the outlet of the second tubing comprises a plurality of perforations through the second tubing, the plurality of perforations configured to direct injection of the second fluid into the formation fluid in the production tubing.

In an eighth aspect according to any one of the first aspect to the seventh aspect, the second fluid comprises a sweet gas comprising a concentration of the acid gas that is less than 20 parts per million.

In a ninth aspect according to any one of the first aspect to the eighth aspect, the second depth is between 500 feet and 2,000 feet. The shallower second depth slight variation is possible as this is linked with well hydraulics, mixing or $H_2S$ dilution efficiency.

In a tenth aspect, a method comprises supporting a production tubing in a wellbore from a terranean surface into a subterranean zone to a first depth in the wellbore, the subterranean zone comprising a formation fluid that comprises a hydrocarbon fluid having a first concentration of an acid gas, the first concentration being greater than a threshold concentration of acid gas, supporting a second tubing in the wellbore and within the production tubing to a second depth in the wellbore less than the first depth, guiding, with the second tubing, a second fluid to an outlet of the second tubing, and circulating, with the outlet of the second tubing, the second fluid into the formation fluid disposed in the production tubing. The second fluid is configured to dilute the formation fluid in the production tubing to a second concentration of the acid gas that is less than the threshold concentration.

In an eleventh aspect according to the tenth aspect, supporting the second tubing in the wellbore and within the production tubing comprises supporting, with an insertion spool of a wellhead, the second tubing independently from the production tubing.

In a twelfth aspect according to the eleventh aspect, guiding the second fluid to the outlet comprises guiding the second fluid from a fluid source through the second tubing, the fluid source comprising at least one of a sweet gas pipeline, a second wellbore, or a fluid treatment facility, the second tubing being fluidly connected to the fluid source.

In a thirteenth aspect according to the twelfth aspect, the fluid source comprises the second wellbore, the method comprises producing sweet gas from the second wellbore, and at least a portion of the second fluid is sourced from the sweet gas from the second wellbore.

In a fourteenth aspect according to the twelfth aspect, the fluid source comprises the fluid treatment facility, the method comprises receiving, at the second tubing, a sweet gas from the fluid treatment facility, and at least a portion of the second fluid is sourced from the sweet gas from the fluid treatment facility.

In a fifteenth aspect according to any one of the tenth aspect to the fourteenth aspect, the outlet comprises a nozzle, and circulating the second fluid into the formation fluid disposed in the production tubing comprises injecting, with the nozzle, the second fluid into the formation fluid in the production tubing.

In a sixteenth aspect according to any one of the tenth aspect to the fourteenth aspect, the outlet comprises a plurality of perforations through the second tubing, and circulating the second fluid into the formation fluid disposed in the production tubing comprises injecting, with the plurality of projections, the second fluid into the formation fluid in the production tubing.

In a seventeenth aspect according to any one of the tenth aspect to the sixteenth aspect, supporting the second tubing to a second depth comprises supporting the second tubing to between 500 feet and 2,000 feet in the wellbore.

In an eighteenth aspect according to any one of the tenth aspect to the seventeenth aspect, the second fluid comprises a sweet gas comprising a concentration of the acid gas that is less than 20 parts per million, and in response to circulating the second fluid into the formation fluid, producing a diluted formation fluid having a concentration of the acid gas that is less than the threshold concentration.

In a nineteenth aspect, a well injection system comprises a well head comprising a production tubing hanger and an insertion spool, the production tubing hanger configured to support a production tubing in a wellbore, and a tubing string connected to and supported by the insertion spool independently from the production tubing, the tubing string configured to be disposed within the production tubing, and the tubing string comprising an outlet configured to circulate a fluid into the production tubing.

In a twentieth aspect according to the nineteenth aspect, the tubing string comprises a coiled tubing, and the outlet comprises at least one of a nozzle or a plurality of perforations in the coiled tubing.

While this disclosure contains many specific implementation details, these should not be construed as limitations on the scope of what may be claimed, but rather as descriptions of features specific to particular implementations. Certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the implementations described above should not be understood as requiring such separation in all implementations, and it should be understood that the described components and systems can generally be integrated together in a single product or packaged into multiple products.

Thus, particular implementations of the subject matter have been described. Other implementations are within the scope of the following claims. Various modifications may be made without departing from the spirit and scope of the disclosure. In some cases, the actions recited in the claims can be performed in a different order and still achieve desirable results. In addition, the processes depicted in the accompanying figures do not necessarily require the particular order shown, or sequential order, to achieve desirable results.

What is claimed is:

1. A well system, comprising:

a production tubing disposed in a wellbore from a terranean surface into a subterranean zone to a first depth in the wellbore, the subterranean zone comprising a formation fluid that comprises a hydrocarbon fluid having a first concentration of an acid gas, the first concentration being greater than a threshold concentration of acid gas; and a second tubing disposed in the wellbore and within the production tubing to a second depth in the wellbore less than the first depth, the second tubing comprising an outlet configured to circulate a second fluid into the formation fluid disposed in the production tubing, the outlet disposed at a longitudinal end of the second tubing at the second depth, the second depth between 500 feet and 2,000 feet, and the second fluid configured to dilute the formation fluid in the production tubing to a second concentration of the acid gas that is less than the threshold concentration.

2. The well system of claim 1, further comprising a well head disposed at the terranean surface to support the production tubing in the wellbore, the well head comprising an insertion spool connected to the second tubing independently from the production tubing.

3. The well system of claim 2, wherein the second tubing comprises a flexible well tubing supported within the production tubing by the insertion spool.

4. The well system of claim 3, wherein the flexible well tubing comprises coiled tubing.

5. The well system of claim 2, wherein the second tubing is fluidly connected to a source of the second fluid, the source of the second fluid comprising at least one of a sweet gas pipeline, a second wellbore, or a fluid treatment facility.

6. The well system of claim 1, wherein the outlet of the second tubing comprises a nozzle configured to inject the second fluid into the formation fluid in the production tubing.

7. The well system of claim 1, wherein the outlet of the second tubing comprises a plurality of perforations through the second tubing, the plurality of perforations configured to direct injection of the second fluid into the formation fluid in the production tubing.

8. The well system of claim 1, wherein the second fluid comprises a sweet gas comprising a concentration of the acid gas that is less than 20 parts per million.

9. The well system of claim 1, wherein the second tubing comprises a fluid valve configured to control a flow of the second fluid out of the outlet.

10. A method, comprising:

supporting a production tubing in a wellbore from a terranean surface into a subterranean zone to a first depth in the wellbore, the subterranean zone comprising a formation fluid that comprises a hydrocarbon fluid having a first concentration of an acid gas, the first concentration being greater than a threshold concentration of acid gas;

supporting a second tubing in the wellbore and within the production tubing to a second depth in the wellbore less than the first depth, the second depth between 500 feet and 2,000 feet in the wellbore;

guiding, with the second tubing, a second fluid to an outlet of the second tubing at a longitudinal end of the second tubing at the second depth; and circulating, with the outlet of the second tubing, the second fluid into the formation fluid disposed in the production tubing, the second fluid configured to dilute the formation fluid in the production tubing to a second concentration of the acid gas that is less than the threshold concentration.

11. The method of claim 10, wherein supporting the second tubing in the wellbore and within the production tubing comprises supporting, with an insertion spool of a wellhead, the second tubing independently from the production tubing.

12. The method of claim 11, wherein guiding the second fluid to the outlet comprises guiding the second fluid from a fluid source through the second tubing, the fluid source comprising at least one of a sweet gas pipeline, a second wellbore, or a fluid treatment facility, the second tubing being fluidly connected to the fluid source.

13. The method of claim 12, wherein the fluid source comprises the second wellbore, the method comprising producing sweet gas from the second wellbore, and at least a portion of the second fluid is sourced from the sweet gas from the second wellbore.

14. The method of claim 12, wherein the fluid source comprises the fluid treatment facility, the method comprising receiving, at the second tubing, a sweet gas from the fluid treatment facility, and at least a portion of the second fluid is sourced from the sweet gas from the fluid treatment facility.

15. The method of claim 10, wherein the outlet comprises a nozzle, and circulating the second fluid into the formation fluid disposed in the production tubing comprises injecting, with the nozzle, the second fluid into the formation fluid in the production tubing.

16. The method of claim 10, wherein the outlet comprises a plurality of perforations through the second tubing, and circulating the second fluid into the formation fluid disposed in the production tubing comprises injecting, with the plurality of perforations, the second fluid into the formation fluid in the production tubing.

17. The method of claim 10, wherein the second fluid comprises a sweet gas comprising a concentration of the acid gas that is less than 20 parts per million, and in response to circulating the second fluid into the formation fluid, producing a diluted formation fluid having a concentration of the acid gas that is less than the threshold concentration.

18. The method of claim 10, comprising controlling, with a fluid valve in the second tubing, a flow of the second fluid to the outlet.

* * * * *